US005306982A

United States Patent [19]

Maillot et al.

[11] Patent Number: 5,306,982

[45] Date of Patent: Apr. 26, 1994

[54] FIELD HARMONIC ENHANCER IN A DEFLECTION YOKE

[75] Inventors: Andre Maillot, Dijon; Marc Milili, Puteaux, both of France

[73] Assignee: Videocolor, Paris la Defense, France

[21] Appl. No.: 799,222

[22] Filed: Nov. 27, 1991

[30] Foreign Application Priority Data

Dec. 12, 1990 [EP] European Pat. Off. ..... 90403538.3

[51] Int. Cl.[5] ..... H01J 29/76; H01F 7/00

[52] U.S. Cl. ..... 313/413; 313/431; 313/426; 313/440; 335/210; 335/213; 335/284; 335/296

[58] Field of Search ..... 313/413, 431, 426, 440; 335/210, 212, 213, 296, 284; 358/251, 252

[56] References Cited

U.S. PATENT DOCUMENTS

| | | | |
|---|---|---|---|
| 4,386,331 | 5/1983 | Kohzuki et al. | 335/213 X |
| 4,524,340 | 6/1985 | Sluyterman | 335/212 |
| 4,853,588 | 8/1989 | Ohtsu et al. | 335/213 X |
| 5,117,151 | 5/1992 | Sluyterman et al. | 313/413 |
| 5,121,028 | 6/1992 | Milili | 335/213 X |
| 5,138,290 | 8/1992 | Togane et al. | 313/440 X |
| 5,204,649 | 4/1993 | Togane et al. | 313/440 X |

OTHER PUBLICATIONS

Article by Heinjnemans et al., published by Philips Tech. Rev. 39, No. 6/7, The Deflection Coils Of The 30 AX Colour-Picture System (undated).

*Primary Examiner*—Donald J. Yusko
*Assistant Examiner*—Ashok Patel
*Attorney, Agent, or Firm*—Joseph S. Tripoli; Joseph J. Laks; Sammy S. Henig

[57] ABSTRACT

In a deflection yoke mounted on a cathode ray tube, a pair of silicon steel field harmonic enhancers are placed over rear portions of a horizontal deflection coil of a saddle coil type near an electron beam entrance region of the coils such that portions of the saddle coils are interposed between the field harmonic enhancers and a neck portion of the cathode ray tube. The field harmonic enhancers reduce horizontal coma error by making the horizontal deflection field in the rear portion of the saddle coils more pincushion shaped.

22 Claims, 6 Drawing Sheets

REAR PART OF YOKE
HORIZONTAL FIELD DISTRIBUTION WITH INTERNAL SILICON STEEL SHUNTS ON HORIZONTAL AXIS AT THE REAR PART OF YOKE
REAR END OF COILS 10
FRONT END OF COILS 10
FRONT PART OF YOKE
H0
H4
8a, 8b
19
H2
15mm
43mm
60mm
Z

FIELD HARMONIC ENHANCER IN A DEFLECTION YOKE

FIELD HARMONIC ENHANCER IN A DEFLECTION YOKE

The invention relates to a deflection yoke corrector that provides, for example, raster coma error correction.

In deflection yokes for cathode ray tubes (CRT) having three horizontal in-line electron beams R, G and B, the red, green and blue beams are required to substantially converge on the CRT display screen. A deflection yoke which does not require dynamic convergence circuitry is referred to as self-converging yoke.

In the self converging yoke, the field intensity or flux lines produced by the horizontal deflection winding or coil are nonuniform and made generally pincushion-shaped at a portion of the yoke, referred to as the main deflection region, that is closer to the screen than to the gun. Consequently, at a given deflection current, the magnetic field in the main deflection region of the yoke is stronger at, for example, the right-center edge of the screen, referred to as the 3 o'clock hour point than at the center of the screen. Such field nonuniformity is known to reduce misconvergence at, for example, the 3 o'clock hour point.

Typically, the horizontal deflection coil is contructed as a pair of saddle coils. An upper one of the pair of saddle coils is placed around an upper half of an envelope of the CRT, above a horizontal plane. The horizontal plane intersects with the screen of the CRT along a horizontal axis X of the CRT. The other one of the saddle coils is placed around a lower half of the envelope of the CRT, below the horizontal plane. A cone shaped insulator or plastic liner has an inner surface placed around and close to the saddle coils so as to surround them. The plastic liner has an outer surface that is, in turn, surrounded by a toroidal vertical deflection coil wound around a magnetic core. Thus, the toroidal vertical deflection coil surrounds at least a substantial portion of the plastic liner that, in turn, surrounds at least a substantial portion of the saddle coils.

The pincushion shaped horizontal deflection field in the main deflection region of each of the saddle coils has a flux density in the vicinity of the red and blue electron beams, when the electron beams form beam spots along horizontal axis X of the CRT, that is stronger than in the vicinity of the green electron beam. Therefore, the pincushion shaped horizontal deflection field in the main deflection region of the saddle coils tends to reduce a width, in the horizontal direction, of a raster produced by the green electron beam relative to a width of a raster produced by the red or by the blue electron beam. Such convergence error is referred to as horizontal coma (hcoma). Hcoma is typically reduced by utilizing a winding distribution in a rear portion of each of the saddle coils, near an electron beam entrance region, that produces a barrel shaped horizontal deflection field in the rear portion of the saddle coils. For a given winding distribution of the saddle coils, one type of hcoma correction requires a horizontal deflection field in the rear portion of the saddle coils that is more pincushion shaped.

In accordance with an aspect of the invention, a pair of arcuate, first and second field harmonic enhancers made of, for example, silicon steel of high permeability are placed, each, near the rear portions of the saddle coils that are near the electron beams entrance region of the saddle coils. The rear portions of the saddle coils are interposed between the field harmonic enhancers and a neck portion of the CRT. One end of each field harmonic enhancer, in a direction of its length dimension, is located above the horizontal plane; the other end is located, illustratively, symmetrically, below the horizontal plane. Thus, each field harmonic enhancer surrounds a corresponding portion of each of the upper and lower saddle coils in the vicinity of the beam entrance region.

The first field harmonic enhancer is located closer to the red electron beam than to the green electron beam. The second field harmonic enhancer is located symmetrically relative to axis Y of the CRT and closer to the blue electron beam than to the green electron beam. The high permeability of the first field harmonic enhancer enhances the horizontal deflection field in the rear portion of the saddle coils near the red electron beam relative to that near the green electron beam. Similarly, the second field harmonic enhancer enhances the horizontal deflection field in the rear portion of the saddle coils near the blue electron beam relative to that near the green electron beam. The result is that the horizontal deflection field in the rear portion of the saddle coils is made more pincushion shaped than what it would have been without the field harmonic enhancers. In this way, closer to optimal hcoma correction may be obtained.

A deflection apparatus embodying an aspect of the invention includes a cathode ray tube of an in-line system including an evacuated glass envelope. A display screen is disposed at one end of the envelope. An electron gun assembly is disposed at a second end of the envelope. The electron gun assembly produces a plurality of electron beams that form corresponding rasters on the screen upon deflection. A deflection yoke is mounted around the envelope and includes a vertical deflection coil for producing a vertical deflection field in the cathode ray tube. First and second horizontal deflection coils each of a saddle type are disposed diametrically opposite with respect to each other for producing a horizontal deflection field in the cathode ray tube. Each of the first and second horizontal deflection coils includes a plurality of conductors forming corresponding first and second lateral winding packets extending in a longitudinal direction of the cathode ray tube. A core made of magnetically permeable material is magnetically coupled to the vertical and horizontal deflection coils. A field former member is disposed in the vicinity of an outer surface of a portion of the first lateral winding packet of the first horizontal deflection coil that is in the vicinity of the beam entrance end of the horizontal deflection coils near the gun assembly. The winding packet portion is interposed between the neck of the envelope and the field former member. The field former member varies a strength of a Fourier coefficient of the horizontal deflection field in the vicinity of the beam entrance end to correct a beam landing error associated with the horizontal deflection coils.

Figure 1:
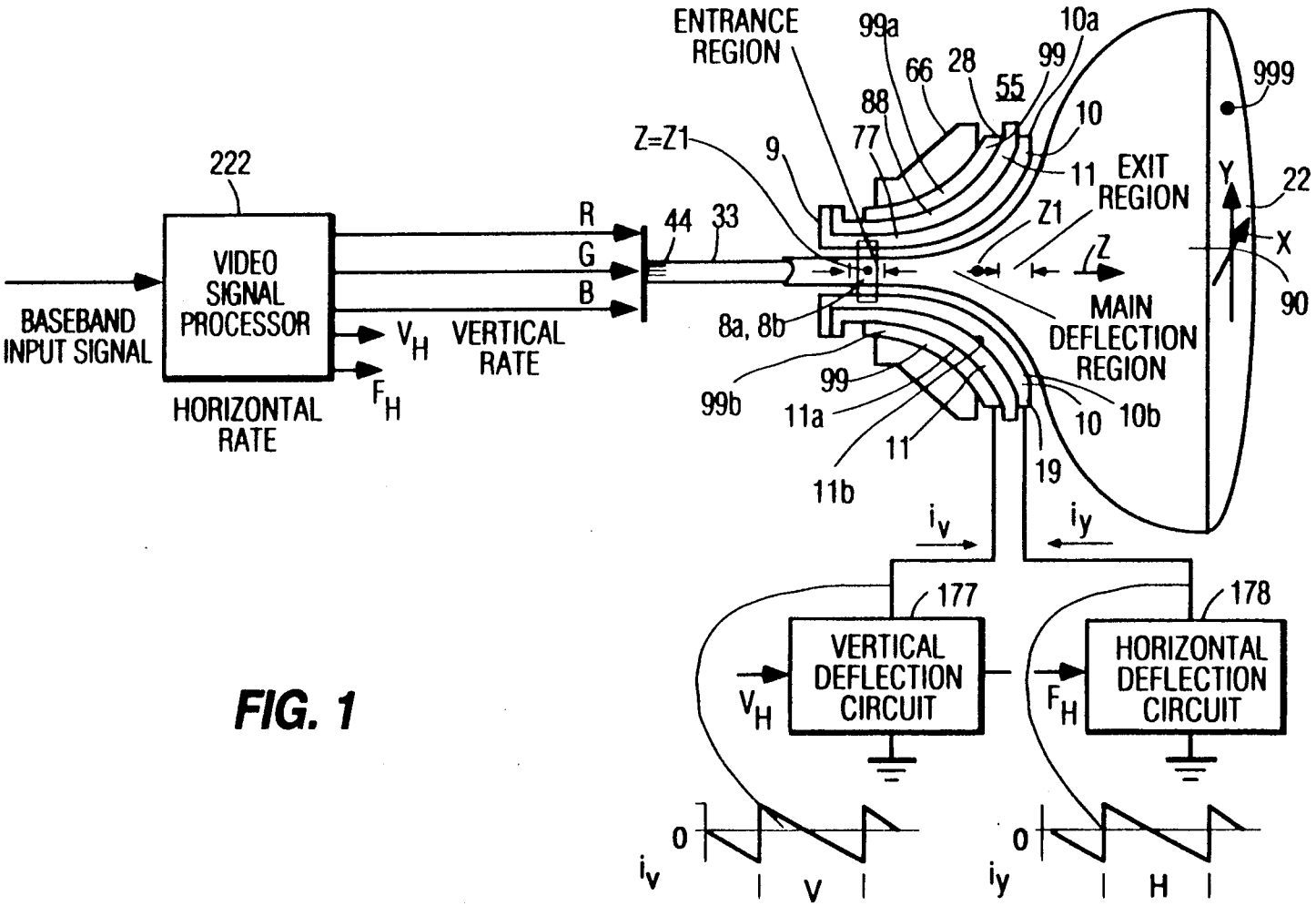
FIG. 1 illustrates a deflection system including a deflection yoke, embodying an aspect of the invention.

FIG. 1 illustrates a longitudinal sectional view in diagrammatic form through an in-line, color television display tube assembly whose longitudinal axis is indicated by Z. An in-line display tube, CRT 90, has a display screen 22 at the conical front of the tube. CRT 90 is, for example, of the type GE A48ATA26X having a deflection angle 90° and a 19 inches or 19 V viewable screen size. It should be understood that a CRT with a different deflection angle may also be used, instead. A neck end 33 remote from display screen 22 contains three in-line electron guns 44 situated in plane X-Z. The longitudinal axis Z lies on that plane with the central electron gun centered on axis Z. Guns 44 produce the three horizontal electron beams R, G and B, that are the red, green and blue beams, respectively. The green electron beam G is the inner electron beam and the blue and red electron beams are the outer electron beams in the three of in-line electron beams. The electron beams are required to substantially converge on the CRT display screen 22.

A self converging deflection yoke 55, embodying an aspect of the invention, is mounted on CRT 90 such that it surrounds a portion of neck 33 and a portion of a conical or flared part of CRT 90. Deflection yoke 55 includes a line deflection coil assembly 77 formed by a pair of saddle coils 10. An upper saddle coil 10*a* of the pair of saddle coils 10 is placed around an upper half of an envelope of CRT 90, above a horizontal plane X-Z formed by axes X and Z of CRT 90. Horizontal plane X-Z intersects with screen 22 of the CRT along horizontal axis X of CRT 90 at the vertical center of screen 22 of CRT 90. The other one of the saddle coils, a coil 10*b*, is placed around a lower half of the envelope of CRT 90, below horizontal plane X-Z and symmetrically opposite with respect to coil 10*a*. A support of insulating material such as plastic whose shape is substantially that of a frustrum, referred to as a plastic liner 11, has an inner surface 11*a* surrounding an upper surface of saddle coils 10. Plastic liner 11 has an outer surface 11*b* that is surrounded by a field deflection coil assembly 88 formed by a pair of toroidal coils 99, including coils 99*a* and 99*b*. Coils 99*a* and 99*b* are wound on a pair of upper and lower core portions 66*a* and 66*b*, respectively, of a core 66 made of soft magnetic material. Coils 10 are driven by a horizontal deflection circuit 178 and coils 99 are driven by a vertical deflection circuit 177 of a television receiver.

Each of saddle coils 10 has a bent, rear end turn portion 9 adjacent electron guns 44, referred to as the gun end. This end turn portion is bent away from the neck of CRT 90 in a direction generally transverse to axis Z. A second, front end turn portion 19 of each of saddle coils 10 is located adjacent display screen 22, referred to as the screen end, and is also bent away from axis Z in a direction generally transversed to axis Z.

Figure 2:
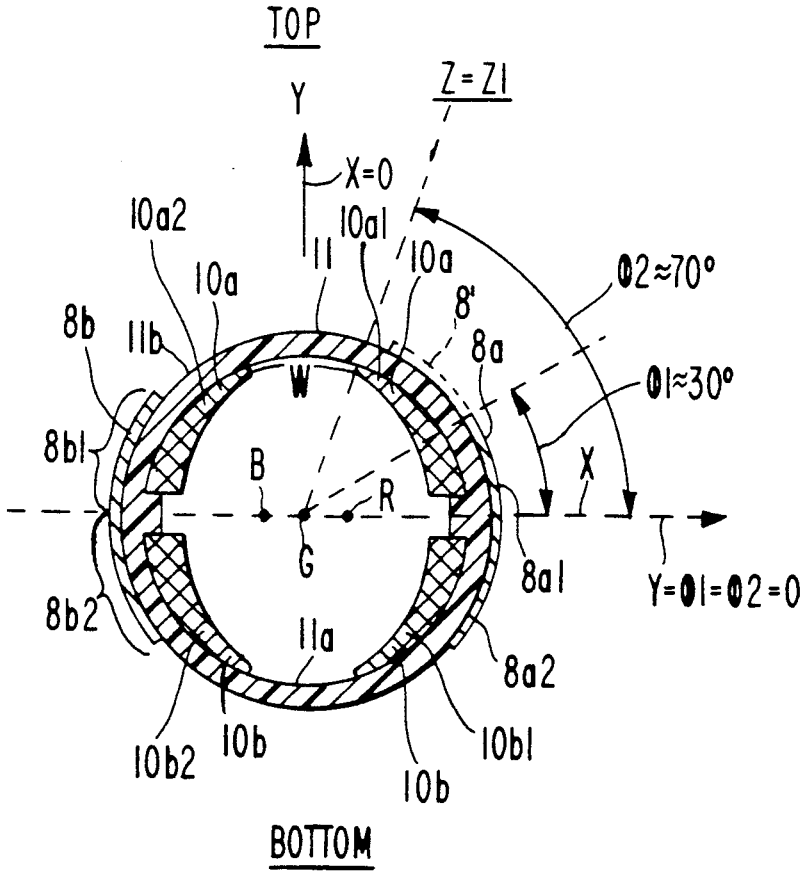
FIG. 2 illustrates a cross sectional view in a plane perpendicular to axis Z at a rear portion of a pair of saddle coils of the yoke of FIG. 1 and a pair of field harmonic enhancers, embodying an aspect of the invention that provide horizontal coma correction.

FIG. 2 illustrates a cross section of yoke 55 in a plane x-y that is perpendicular to axis Z having the coordinate Z=Z1. Axes x and y of FIG. 2 are in parallel with axes X and Y of CRT 90 of FIG. 1, respectively. Similar numbers and symbols in FIGS. 1 and 2 indicate similar items or functions. A first lateral winding packet 10*a*1 and a second lateral winding packet 10*a*2 of FIG. 2 that extend in a direction of axis Z, in a manner not shown in FIG. 2, define a winding window W of coil 10*a* with a portion of coil 10*a* that is not shown in FIG. 2. Similarly, lateral winding packets 10*b*1 and 10*b*2 define a corresponding winding window of coil 10*b*. Coils 10*a* and 10*b* are disposed diametrically opposite with respect to axis x of plane x-y.

The field intensity or flux lines produced by coils 10 of FIG. 1 are nonuniform and made generally pincushion-shaped at a portion of the yoke, referred to as the main deflection region, that is closer to screen 22 than to guns 44. Consequently, the horizontal deflection field in the main deflection region of the yoke is stronger at, for example, the right-center edge of the screen, referred to as the 3 o'clock hour point than at the center of the screen. Such field nonuniformity is known to reduce misconvergence at, for example, the 3 o'clock hour point.

Hcoma is reduced, in part, by employing a predetermined winding distribution in a rear portion of each of saddle coils 10 near an electron beam entrance region in the vicinity of a coordinate Z=Z1 such that a barrel shaped horizontal deflection field is produced in the rear portion of horizontal deflection saddle coils 10. Convergence errors are corrected in the main deflection region of yoke 55, between the beam exit and entrance regions of yoke 55. Geometry errors at the extreme edges of the display screen are corrected in the exit region. The winding distribution in coils 10, established for correcting various beam landing errors, may not by itself provide sufficient pincushion shaped field nonuniformity for obtaining optimal hcoma correction.

In accordance with an aspect of the invention, a pair of arcuate field formers or field harmonic enhancers 8*a* and 8*b* of FIG. 2 made, for example, entirely of silicon steel having high permeability are placed, each, on outer surface 11*b* of plastic liner 11. Surface 11*b* is located between vertical deflection coil 99 and an outer surface of coils 10. An inner surface of coil 10*a* is located closer to neck 33 of CRT 90 than the outer surface of coil 10*a*. Field harmonic enhancer 8*a* overlaps and bridges portions of lateral winding packets 10*a*1 and 10*b*1 of coils 10*a* and 10*b*, respectively. Each of the portion of packets 10*a*1 and 10*b*1 that is overlapped by field harmonic enhancer 8*a* is closer to electron beams R, G and B than field harmonic enhancer 8*a*. Similarly, field harmonic enhancer 8*b* overlaps and bridges portions of packets 10*a*2 and 10*b*2. A midpoint of a width dimension of each of field harmonic enhancers 8*a* and 8*b* of FIG. 1 is shown illustratively as being located at coordinate Z=Z1. Field harmonic enhancers 8*a* and 8*b* are placed in the vicinity of the beam paths where the three beams are not yet deflected significantly. The rear portions of saddle coils 10*a* and 10*b* are interposed between field harmonic enhancer 8*a* or 8*b* and neck portion 33 of CRT 90.

Field harmonic enhancers 8*a* and 8*b* are located symmetrically relative to axis y of FIG. 2. Upper half portion 8*b*1 and lower half portion 8*b*2 of field harmonic enhancer 8*b* are located symmetrically relative to axis x. Similarly, upper half portion 8*a*1 and lower half portion 8*a*2 of field harmonic enhancer 8*a* are located symmetrically relative to axis x. Each of field hramonic enhancers 8*a* and 8*b* that is arcuate surrounds a corresponding arcuate portion formed by each of rear end portions or sections of saddle coils 10*a* and 10*b* in the vicinity of the beam entrance region at, for example, coordinate Z=Z1. Field harmonic enhancer 8*a*, for example, is placed between angle $\phi 1=+30°$ and $\phi 1=-30°$ of FIG. 2. An angle $\phi 2$, between axis x and the side of window W of coil 10*a*, is larger than angle $\phi 1$.

Field harmonic enhancer 8*a* is located closer to the red electron beam R than to the green electron beam G. Field harmonic enhancer 8*b* is located closer to the blue electron beam B than to the green electron beam G. Field harmonic enhancer 8*a* enhances the strength of the horizontal deflection field in the rear portion of saddle coils 10 in the vicinity of coordinate Z=Z1 near the red electron beam R relative to that near the green electron beam G. Field harmonic enhancer 8*b* enhances the strength of the horizontal deflection field in the rear portion of coils 10 in the vicinity of coordinate Z=Z1, near the blue electron beam B relative to that near the green electron beam G. The result is that the horizontal deflection field in the rear portion of the saddle coils is made more pincushion shaped than what it would have been without field harmonic enhancers 8*a* and 8*b*. Consequently, field harmonic enhancers 8*a* and 8*b* cause the width of the rasters formed by red electron beam R and blue electron beam B to increase relative to that formed by the green electron beam G. In this way, closer to optimal hcoma correction may be obtained.

Figure 4:
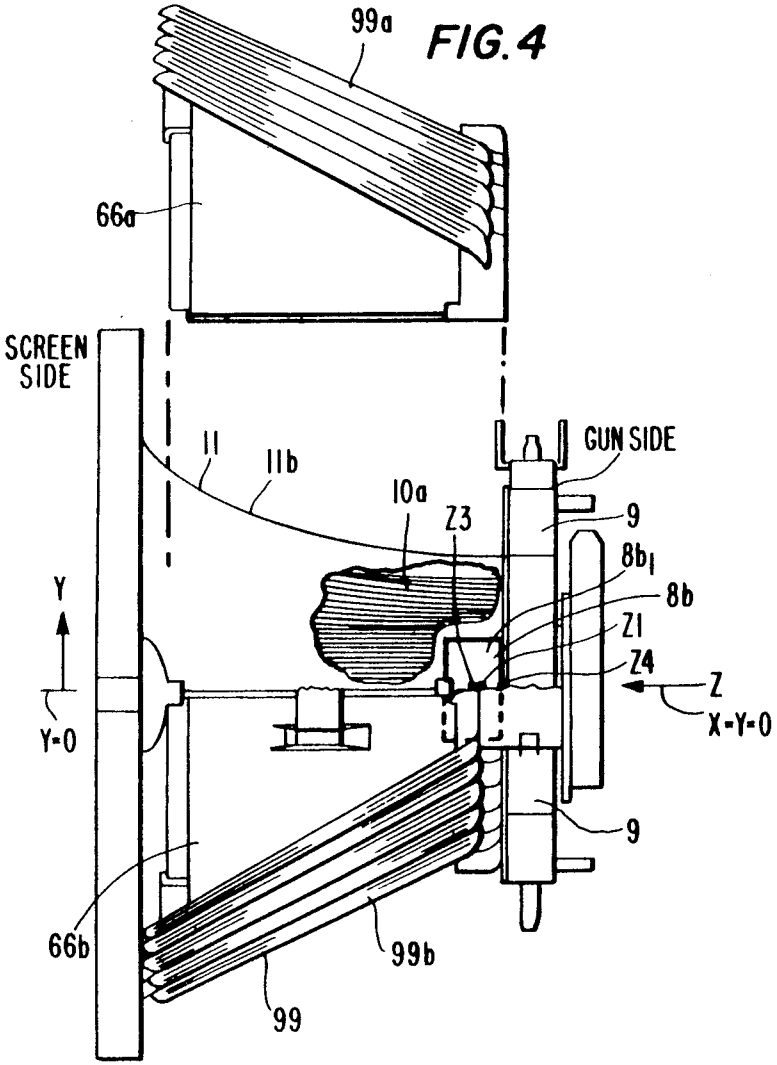
FIG. 4 illustrates a partially exploded side view of the yoke of FIG. 3.
Figure 3:
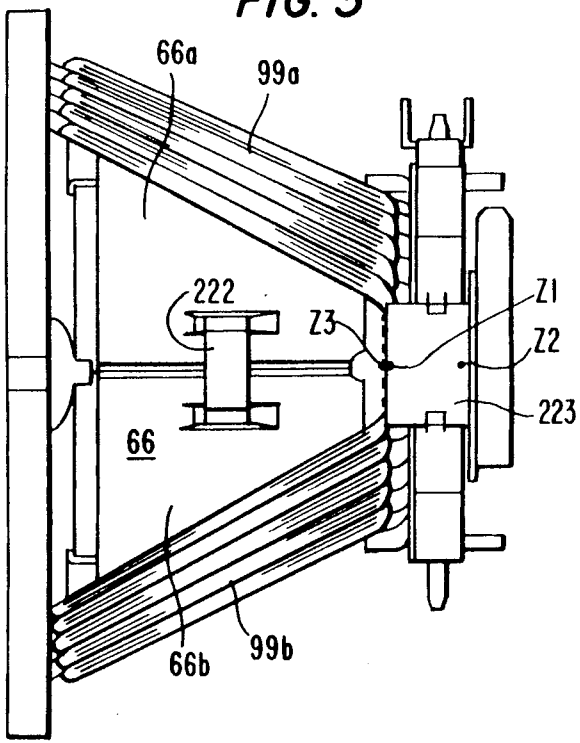
FIG. 3 illustrates a side view of the yoke of FIG. 1.

FIG. 3 illustrates a side view and FIG. 4 illustrates an exploded side view with a partial cutout of yoke 55 of FIG. 1. Similar symbols and numerals in FIGS. 1–4 indicate similar items or functions.

In FIG. 3, core 66 is shown as being formed by upper core portion 66*a* and by lower core portion 66*b* that are joined by a pair of resilient clips 222. Upper toroidal coil 99*a* of vertical deflection coil 99 is wound around core portion 66*a* and lower toroidal coil 99*b* of vertical deflection coil 99 is wound around core portion 66*b*. An arrangement 223, not shown in detail, that includes a permeable material collects flux of a vertical deflection field and channels the collected flux to a region of neck 33 of CRT 90 in the vicinity of a coordinate Z=Z2, in the rear of yoke 55 that is further away from screen 22 than coordinate Z=Z1. Arrangement 223 forms a quadrupole field, not shown, at a vertical rate in a plane that is parallel with plane X-Z at coordinate Z=Z2 that corrects vertical coma, in a well known manner.

In FIG. 4, for explanation purposes, a portion of outer surface 11*b* of plastic liner 11 is shown exposed and core portion 66*a* and coil 99*a* that is wound thereon are shown lifted up. Also, a cutout in plastic liner 11 exposes, for explanation purposes, a packet of conductor wires that extend in a direction of axis Z that form a portion of upper saddle coil 10*a*. As can be seen, coil 10*a* extends toward the rear of yoke 55 to a coordinate Z=Z4 that is further from screen 22 of CRT 90 of FIG. 1 than the rearmost portion of vertical deflection coils 99 and of core 66 at a coordinate Z=Z3. For explanation purposes, upper half portion 8*b*1 of field harmonic enhancer 8*b* that abuts upper surface 11*b* of plastic liner 11 is also shown exposed, when core portion 66*a* is lifted up.

Field harmonic enhancer 8*b* of FIG. 4 includes a portion in the direction of axis Z between coordinates Z=Z3 and Z=Z4 that overlaps portions of both coils 10*a* and 10*b* but that does not overlap core 66 since it extends further from the screen side of yoke 55 than the rearmost or end portion of core 66 at coordinate Z=Z3.

The strength or intensity of the magnetic field produced by saddle coils 10 can be measured with a suitable probe. Such measurement can be performed for a given coordinate Y=O and Z=Z1 of FIG. 1 and for a given coordinate X=X1, where coordinate X1 varies in a direction parallel to axis X, the horizontal deflection direction. The plane X-Z in which coordinate X=X1 varies separates saddle coils 10.

The results of measuring the strength of the magnetic field as a function of coordinate X, for a constant coordinate Z=Z1 and for a coordinate Y=O, can be used for computing in a well known manner field distribution functions or Fourier coefficients H0(Z1), H2(Z1) and H4(Z1) of a power series $H(X)=H0(Z1)+H2(Z1)X^2+H4(Z1)X^4$. The term H(X) represents the strength of the magnetic field as a function of the X coordinate, at the coordinates Z=Z1, Y=O. The coefficients H0(Z), H2(Z) and H4(Z) can then be computed for different values of the coordinate Z. A graph can then be plotted depicting the variation of each of coefficients H0(Z), H2(Z) and H4(Z) as a function of the coordinate Z. Field distribution function H2 is determined significantly by the third harmonic of the winding distribution in the saddle coil. The magnitude of the third harmonic is computed using the Fourier analysis technique.

Figure 5:
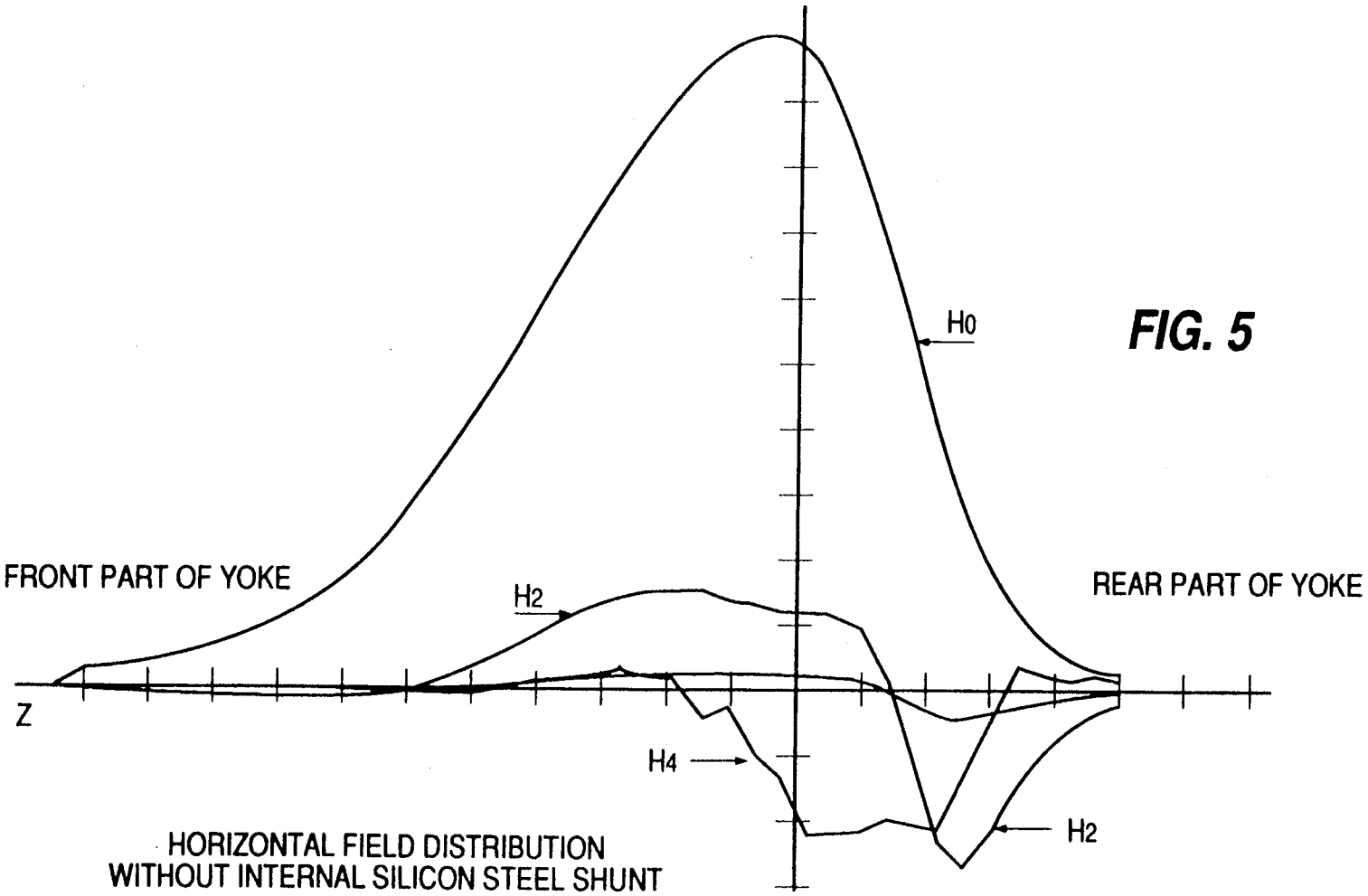
FIG. 5 illustrates a field distribution function of the yoke of FIG. 1 when the field harmonic enhancers of FIG. 2 are not employed.
Figure 6:
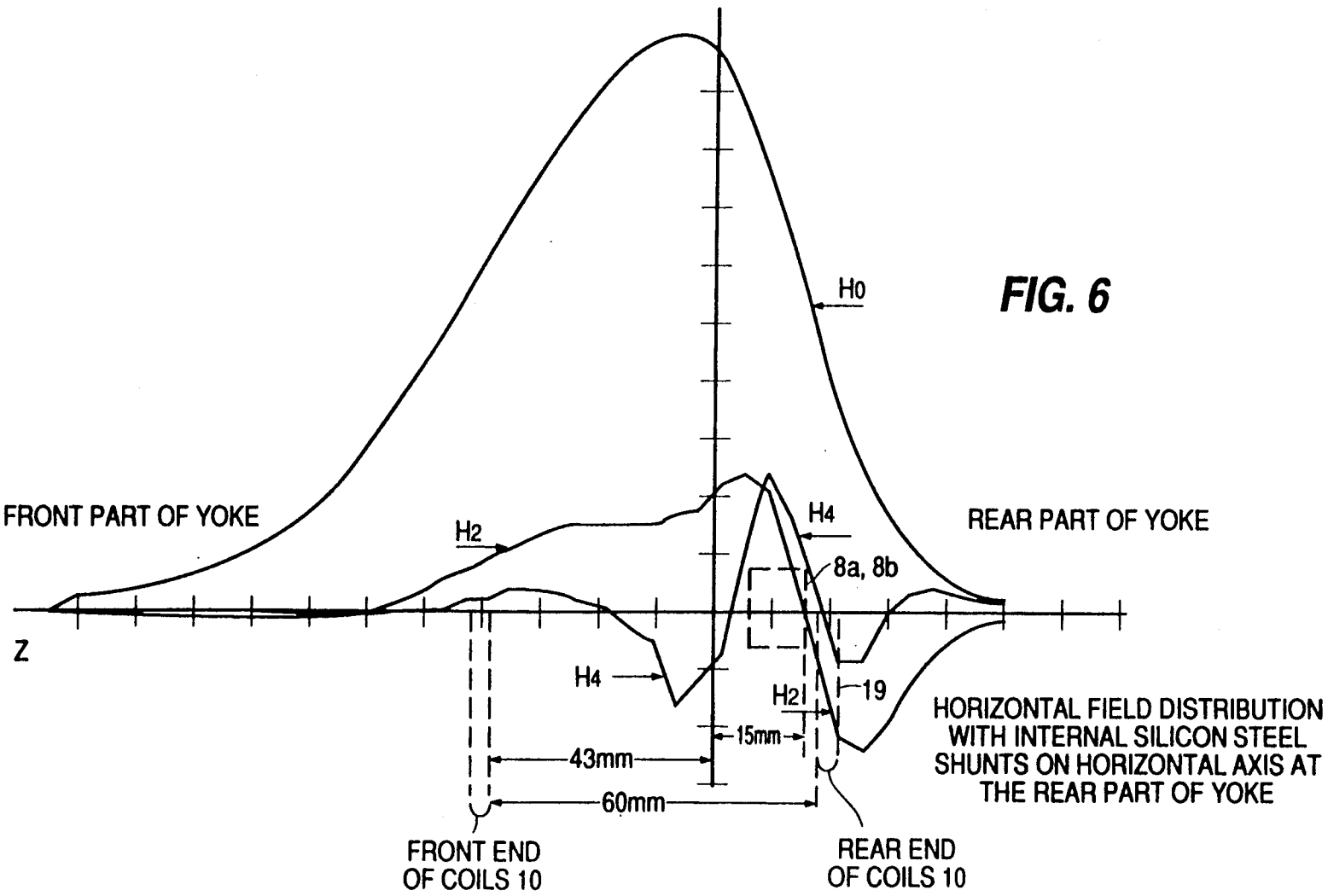
FIG. 6 illustrates a field distribution function of the yoke of FIG. 1 when the field harmonic enhancers of FIG. 2 are employed.

FIG. 5 illustrates a graph depicting the variations of coefficients H0(Z), H2(Z) and H4(Z) for yoke 55 of FIG. 1 when field harmonic enhancers 8*a* and 8*b* are not utilized. FIG. 6 illustrates a graph depicting the variations of the coefficients when field harmonic enhancers 8*a* and 8*b* are utilized. The field harmonic enhancers 8*a* and 8*b* enhance coefficient H2 in the rear portion of saddle coils 10. The positive increase in coefficient H2 indicates that the horizontal deflection field in the rear portion of coils 10 becomes more pincushion shaped when field harmonic enhancers 8*a* and 8*b* are used than without them. Because the beams are not yet significantly deflected in the rear portion of coils 10, the enhanced pincushion shaped horizontal deflection field causes the red beam R and the blue beam B to be deflected more than the green beam G. Thus, the type of hcoma error of the arrangement of FIG. 1 is corrected.

It should be understood that in a different deflection system in which correction of hcoma requires the red beam R and the blue beam B to be deflected more than the green beam G, field formers would be placed between different angles in a manner to produce a negative increase in coefficient H2 for correcting hcoma. Negative increase in coefficient H2 may be produced by utilizing, for example, four field formers, symmetrically, to axes x and y of FIG. 2. Thus, for example, in a first quadrant of axes x and y of FIG. 2 a field former 8′ may be placed between angle $\phi 1=30°$ and $\phi 1=60°$, as shown in broken lines.

Field harmonic enhancers 8*a* and 8*b* of FIG. 1 may have a tendency to increase positive overconvergence at 6 and 12 o'clock hour points of screen of CRT 90 of FIG. 1. They also may have a tendency to increase negative overconvergence at the 3 and 9 o'clock hour points, hence a more positive horizontal trap error could result. Such overconvergence and trap error can be reduced by varying other parameters such as by varying the winding distribution of coils 10. After such overconvergence and trap error are reduced, the hcoma error is maintained, advantageously, smaller than if field harmonic enhancers 8*a* and 8*b* were not utilized. Field harmonic enhancers 8*a* and 8*b* do not produce a significant effect on north-south geometry pincushion distortion after the aforementioned overconvergence is readjusted.

Figure 7:
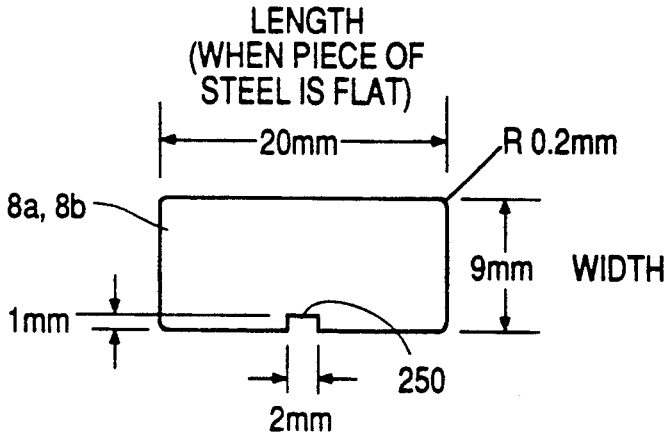
FIGS. 7 and 8 illustrate top and side views of one of the field harmonic enhancers of FIG. 2.
Figure 8:
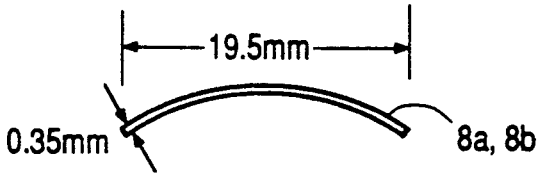

FIGS. 7 and 8 illustrate top and side views of field harmonic enhancer 8*a* or 8*b* of FIG. 1. Similar symbols and numerals in FIGS. 1–8 indicate similar items or functions. Field harmonic enhancer 8*a* or 8*b* of FIG. 7 includes a notch 250 that mates with a corresponding rib in liner 11 for mechanically fixing the position of the field harmonic enhancer on liner 11 relative to saddle coils 10. The width dimension of field harmonic enhancer 8*a* or 8*b* of FIG. 7 that is in the direction of axis Z is selected to obtain the required effect on hcoma. The length dimension of field harmonic enhancer 8*a* or 8*b* or the angle, that is equal to twice the angle $\phi 1$ in plane x-y is also selected to obtain the required effect on hcoma. A smaller length reduces the effect of the field harmonic enhancer on hcoma and causes an increase in the variations of coefficient H4(Z) of FIG. 5 or 6. Whereas, an increase in the length of field harmonic enhancer 8*a* or 8*b* of FIG. 7 or 8 increases its effect on hcoma and decreases the variations of coefficient H4(Z) of FIG. 5 or 6. Thus, the length of the field harmonic enhancer is selected to provide an optimized trade-off between its effect on hcoma and on other parameters of the yoke.

What is claimed is:

1. A deflection apparatus, comprising:

a cathode ray tube of an in-line system including an evacuated glass envelope, a display screen disposed at one end of said envelope, an electron gun assembly disposed at a second end of said envelope, said electron gun assembly producing a plurality of electron beams that form corresponding rasters on said screen upon deflection;

a deflection yoke mounted around said envelope, including:

at least one vertical deflection coil for producing a vertical deflection field in said cathode ray tube;

first and second horizontal deflection coils each of a saddle type disposed opposite with respect to each other for producing a horizontal deflection field in said cathode ray tube, each of said first and second horizontal deflection coils including a plurality of conductors forming corresponding first and second lateral winding packets extending in a longitudinal direction of said cathode ray tube;

a core made of magnetically permeable material magnetically coupled to said vertical and horizontal deflection coils; and at least one field former member disposed in the vicinity of a beam entrance section of said horizontal deflection coils near said gun assembly, said at least one field former member comprising a first field former member disposed in the vicinity of said beam entrance section of said horizontal deflection coils, such that a portion of said first lateral winding packet of said first horizontal deflection coil and a portion of said first lateral winding packet of said second horizontal deflection coil are interposed between the neck of said envelope and said first field former member, said first field former member varying a strength of a Fourier coefficient of said horizontal deflection field in the vicinity of said beam entrance section to correct a beam landing error associated with said horizontal deflection coils.

2. An apparatus according to claim 1 wherein said first field former member enhances said strength of said Fourier coefficient that is H2(Z) Fourier coefficient.

3. An apparatus according to claim 1 wherein said first field former member varies said strength of said fourier coefficient in a manner to correct horizontal coma.

4. An apparatus according to claim 1 wherein a horizontal coma correction requires a positive increase in the strength of said horizontal deflection field in the vicinity of an outer electron beam of said electron beams near the beam entrance section of said horizontal deflection coils relative to the strength of said horizontal deflection field in the vicinity of an inner electron beam of said electron beams and wherein said first field former member is placed in an angular position with respect to an X-axis that provides the required positive increase in the strength of said horizontal deflection field for correcting horizontal coma.

5. An apparatus according to claim 4 wherein said first field former member produces a positive increase of a strength of an H2(Z) Fourier coefficient of said horizontal deflection field.

6. An apparatus according to claim 1 wherein a horizontal coma correction requires a negative increase in the strength of said horizontal deflection field in the vicinity of an outer electron beam of said electron beams near the beam entrance section of said horizontal deflection coils relative to the strength of said horizontal deflection field in the vicinity of an inner electron beam of said electron beams and wherein said first field former member is placed in an angular position with respect to an X-axis that provides the required negative increase in the strength of said horizontal deflection field for correcting horizontal coma.

7. A deflection apparatus, comprising:

a cathode ray tube of an in-line system including an evacuated glass envelope, a display screen disposed at one end of said envelope, an electron gun assembly disposed at a second end of said envelope, said electron gun assembly producing a plurality of electron beams that form corresponding rasters on said screen upon deflection;

a deflection yoke mounted around said envelope, including:

at least one vertical deflection coil for producing a vertical deflection field in said cathode ray tube;

first and second horizontal deflection coils each of a saddle type disposed diametrically opposite with respect to each other for producing a horizontal deflection field in said cathode ray tube, each of said first and second horizontal deflection coils including a plurality of conductors forming corresponding first and second lateral winding packets extending in a longitudinal direction of said cathode ray tube;

a core made of magnetically permeable material magnetically coupled to said vertical and horizontal deflection coils; and at least one field former member disposed in the vicinity of a beam entrance section of said horizontal deflection coils near said gun assembly, said at least one field former member comprising a first field former member disposed in the vicinity of said beam entrance section, in a manner to bridge a portion of said first lateral winding packet of said first horizontal deflection coil and a portion of said first lateral winding packet of said second horizontal deflection coil, said portion of said first lateral winding packet of said first horizontal deflection coil and said portion of said first lateral winding packet of said second horizontal deflection coil being disposed adjacent each other and further being interposed between the neck of said envelope and said first field former member, said first field former member varying a strength of a Fourier coefficient of said horizontal deflection field that is produced in said vicinity of said beam entrance section in a manner to correct for a beam landing error.

8. An apparatus according to claim 7 further comprising, a second field former member disposed in the vicinity of the beam entrance section of said horizontal deflection coils near said gun assembly, in a manner to bridge a portion of said second lateral winding packet of said first horizontal deflection coil and a portion of said second lateral winding packet of said second horizontal deflection coil, said portion of said second lateral winding packet of said first horizontal deflection coil and a portion of said second lateral winding packet of said second horizontal deflection coil being disposed adjacent each other and further being interposed between the neck of said envelope and said second field former member, said second field former member varying the strength of the Fourier coefficient of said horizontal deflection field that is produced in said vicinity of said beam entrance section in a manner to correct for said beam landing error.

9. An apparatus according to claim 8 wherein each of said horizontal deflection coils forms first and second winding windows, respectively, and wherein each of said first and second field former members is disposed entirely outside each of said winding windows.

10. An apparatus according to claim 8 wherein said first and second lateral winding packets of said first horizontal deflection coil form a winding window therebetween, and wherein each of said first and second field former members is disposed entirely outside said winding window.

11. An apparatus according to claim 8 wherein said first and second field former members enhance the strength of said horizontal deflection field in the vicinity of each of a pair of outer electron beams of said electron beams relative to the strength of said horizontal deflection field in the vicinity of an inner electron beam of said electron beams.

12. An apparatus according to claim 8 wherein said first and second field former members make said horizontal deflection field more pincushion shaped in the vicinity of the beam entrance section of said horizontal deflection coils near said gun assembly than what it would have been without said field former members.

13. An apparatus according to claim 8 wherein said first and second field former members reduce horizontal coma error.

14. An apparatus according to claim 7 further comprising, an insulator for mounting said horizontal deflection coils on an inner surface thereof and said vertical deflection coil on an outer surface thereof and wherein said first field former member is disposed on said outer surface of said insulator.

15. An apparatus according to claim 14 wherein said first field former member includes a notch for mating with a rib of said insulator to establish a position of said first field former member relative to said horizontal deflection coils.

16. An apparatus according to claim 7 wherein said first field former member is made of a soft magnetic material having a high permeability.

17. An apparatus according to claim 16 wherein said first field former member is made of silicon steel.

18. An apparatus according to claim 7 wherein said core surrounds a corresponding portion of each of said horizontal deflection coils and wherein at least a first portion of said first field former member extends outside the portions of said horizontal deflection coils that are surrounded by said core.

19. An apparatus according to claim 18 wherein a second portion of said first field former member is interposed between said core and said neck of said cathode ray tube.

20. An apparatus according to claim 7 wherein said first lateral winding packet of said first horizontal deflection coil and said first lateral winding packet of said second horizontal deflection coil are disposed in one side of a Y-Z plane of said cathode ray tube and wherein said second lateral winding packet of said first horizontal deflection coil and said second lateral winding packet of said second horizontal deflection coil are disposed in the other side of said Y-Z plane of said cathode ray tube.

21. An apparatus according to claim 7 wherein said first lateral winding packet of said first horizontal deflection coil and said second lateral winding packet of said first horizontal deflection coil are disposed in one side of an X-Z plane of said cathode ray tube and wherein said first lateral winding packet of said second horizontal deflection coil and said second lateral winding packet of said second horizontal deflection coil are disposed in the other side of said X-Z plane of said cathode ray tube.

22. A deflection apparatus, comprising:

a cathode ray tube of an in-line system including an evacuated glass envelope, a display screen disposed at one end of said envelope, an electron gun assembly disposed at a second end of said envelope, said electron gun assembly producing a plurality of electron beams that form corresponding rasters on said screen upon deflection;

a deflection yoke mounted around said envelope, including:

at least one vertical deflection coil for producing a vertical deflection field in said cathode ray tube;

first and second horizontal deflection coils each of a saddle type disposed opposite with respect to each other for producing a horizontal deflection field in said cathode ray tube;

a core made of magnetically permeable material magnetically coupled to said vertical and horizontal deflection coils; and first and second field former members disposed in the vicinity of a pair of outer electron beams, respectively, of said electron beams and in the vicinity of an outer surface of a rear end portion of said first and second horizontal deflection coils that is close to the beam entrance end of said horizontal deflection coils near said gun assembly, said field former members varying the strength of said horizontal deflection field that is produced in the vicinity of said pair of outer electron beams relative to the strength of said horizontal deflection field in the vicinity of an inner electron beam of said electron beams in a manner to reduce horizontal coma error such that said rear end portion of said first and second horizontal deflection coils is interposed between the neck of said envelope and each of said first and second field former members.

* * * * *